US008991921B2

(12) United States Patent
Peterson et al.

(10) Patent No.: US 8,991,921 B2
(45) Date of Patent: Mar. 31, 2015

(54) SEATING UNIT WITH SEAT POSITION AND DEPTH ADJUSTMENT ASSEMBLY

(75) Inventors: Gordon Jay Peterson, Rockford, MI (US); Jennifer Kristy Geister, Alto, MI (US)

(73) Assignee: Steelcase Inc., Grand Rapids, MI (US)

( * ) Notice: Subject to any disclaimer, the term of this patent is extended or adjusted under 35 U.S.C. 154(b) by 199 days.

(21) Appl. No.: 13/553,979

(22) Filed: Jul. 20, 2012

(65) Prior Publication Data

US 2014/0021759 A1 Jan. 23, 2014

(51) Int. Cl.
*A47C 3/00* (2006.01)
*A47C 1/023* (2006.01)

(52) U.S. Cl.
CPC ..... *A47C 1/023* (2013.01)
USPC ..... 297/284.11; 297/284.1

(58) Field of Classification Search
USPC ..... 297/284.3, 284.11, 201, 215.16
See application file for complete search history.

(56) References Cited

U.S. PATENT DOCUMENTS

| | | | | |
|---|---|---|---|---|
| 278,870 | A | 6/1883 | Burnham | |
| 476,922 | A | 6/1892 | Geertz | |
| 2,924,265 | A | 2/1960 | Himka | |
| 2,931,427 | A | 4/1960 | Goldstein | |
| 3,411,824 | A | 11/1968 | White et al. | |
| 3,554,599 | A | 1/1971 | Pietschmann | |
| 3,625,564 | A | 12/1971 | Holstad | |
| 3,802,737 | A | 4/1974 | Mertens | |
| 4,401,343 | A | 8/1983 | Schmidt | |
| 4,773,703 | A | 9/1988 | Krugener et al. | |
| 5,035,466 | A | 7/1991 | Mathews et al. | |
| 5,121,515 | A | 6/1992 | Hudson | |
| 5,171,062 | A * | 12/1992 | Courtois | 297/340 |
| 5,370,444 | A | 12/1994 | Stulik | |
| 5,380,063 | A | 1/1995 | Dauphin | |
| 5,402,544 | A | 4/1995 | Crawford et al. | |
| 5,462,337 | A | 10/1995 | Yamakami | |
| 5,491,852 | A | 2/1996 | Maucher | |
| 5,520,438 | A | 5/1996 | Stulik | |
| 5,544,942 | A | 8/1996 | Vu Khac et al. | |
| 5,797,576 | A | 8/1998 | Gauger | |
| 5,871,258 | A | 2/1999 | Battey et al. | |
| D407,937 | S | 4/1999 | Klimento | |
| 6,022,074 | A | 2/2000 | Swedenklef | |
| D422,151 | S | 4/2000 | Hwang et al. | |
| 6,082,207 | A | 7/2000 | Babinski | |
| 6,082,824 | A | 7/2000 | Chow | |
| 6,106,063 | A | 8/2000 | Dauphin | |
| 6,135,556 | A | 10/2000 | Chu et al. | |
| 6,189,971 | B1 | 2/2001 | Witzig | |
| D446,983 | S | 8/2001 | Roberts et al. | |
| 6,273,506 | B1 | 8/2001 | Niergarth et al. | |
| 6,375,261 | B1 * | 4/2002 | Link | 297/284.11 |
| 6,394,548 | B1 | 5/2002 | Battey et al. | |

(Continued)

FOREIGN PATENT DOCUMENTS

| | | |
|---|---|---|
| DE | 4040138 A1 | 6/1992 |
| DE | 4126520 C2 | 5/1993 |

(Continued)

*Primary Examiner* — Sarah B McPartlin

(57) ABSTRACT

A seating unit having a seat assembly and an adjustment assembly coupled to the seat assembly is provided, where the adjustment assembly includes a single drive mechanism for translating the seat assembly from a first position to a second position and expanding the seat assembly from a first configuration to a second configuration.

30 Claims, 7 Drawing Sheets

(56) References Cited

U.S. PATENT DOCUMENTS

| | | | |
|---|---|---|---|
| 6,601,918 | B2 | 8/2003 | Mattsson |
| 6,611,979 | B2 | 9/2003 | Welling et al. |
| 6,663,178 | B2 | 12/2003 | Fourrey et al. |
| 6,923,361 | B2 | 8/2005 | Maeda |
| 6,926,361 | B2 | 8/2005 | Link |
| 6,994,400 | B2 | 2/2006 | Koepke et al. |
| 7,104,609 | B2 | 9/2006 | Kim |
| 7,108,322 | B2 | 9/2006 | Erker |
| 7,159,942 | B2 | 1/2007 | Costaglia |
| 7,249,802 | B2 | 7/2007 | Schmitz et al. |
| 7,421,922 | B2 | 9/2008 | Hamann et al. |
| 7,441,839 | B2 | 10/2008 | Pennington et al. |
| 7,478,880 | B2 | 1/2009 | Johnson et al. |
| D591,996 | S | 5/2009 | Green et al. |
| 7,547,064 | B2 | 6/2009 | Garneau |
| 7,556,313 | B2 | 7/2009 | Browne et al. |
| D597,778 | S | 8/2009 | Pittman |
| 7,611,201 | B2 | 11/2009 | Moriyama et al. |
| 7,669,928 | B2 | 3/2010 | Snyder |
| 7,712,837 | B2 | 5/2010 | Ekornes |
| 2003/0214166 | A1 | 11/2003 | Schambre et al. |
| 2005/0035638 | A1 | 2/2005 | Pennington et al. |
| 2008/0217977 | A1 | 9/2008 | Aldrich et al. |
| 2009/0033134 | A1 | 2/2009 | Hofmann et al. |
| 2009/0218864 | A1 | 9/2009 | Parker et al. |

FOREIGN PATENT DOCUMENTS

| | | | |
|---|---|---|---|
| DE | 19845265 | A1 | 4/2000 |
| DE | 19641836 | C2 | 5/2000 |
| DE | 19955296 | C1 | 2/2001 |
| DE | 19941914 | A1 | 4/2001 |
| DE | 10341176 | B3 | 1/2005 |
| DE | 10353522 | A1 | 6/2005 |
| DE | 102004030363 | A1 | 1/2006 |
| DE | 102006018353 | B4 | 6/2008 |
| DE | 102008006019 | A1 | 10/2008 |
| DE | 102008046000 | A1 | 6/2009 |
| DE | 102008006547 | A1 | 8/2009 |
| DE | 202009005026 | U1 | 12/2009 |
| EP | 0962170 | | 12/1999 |
| EP | 1393655 | B1 | 11/2005 |
| EP | 1413227 | B1 | 3/2006 |
| EP | 2005859 | A1 | 12/2008 |
| EP | 1807282 | B1 | 8/2009 |
| WO | 9011707 | | 10/1990 |
| WO | 9963866 | | 12/1999 |
| WO | 2005065486 | A1 | 7/2005 |
| WO | 2010068122 | A1 | 6/2010 |

* cited by examiner

SEATING UNIT WITH SEAT POSITION AND DEPTH ADJUSTMENT ASSEMBLY

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates to a seating unit having a position- and depth-adjustable seat. In particular, the present invention relates to a seating unit including a seat assembly which is expandable between a first configuration and a second configuration and translatable between a first position and a second position.

Today, persons engage in a variety of sedentary activities which involve prolonged periods of sitting, such as watching television, working in an office and traveling. There are also those with physical disabilities who are confined to a wheelchair. In a seated position, a majority of a user's weight is transferred primarily to the ischial tuberosities ("sitting bones") of the pelvis and their surrounding soft tissues. Weight is also transferred to the thighs. Regardless of the sedentary activity, prolonged sitting without proper support can cause discomfort to the lower body and back. A seating unit having adjustable seat depth and position can help alleviate this discomfort.

Modern consumers demand a wide variety of seating options and features, including an adjustable support which allows for major differences in the shape and size of users. Known seating units provide mechanisms for adjusting the seat position to support the ischial tuberosities and adjusting the seat depth to support the thighs. However, these seating units utilize separate adjustment mechanisms and user controls. Also, translation and expansion movements of the seat are not coordinated to provide a smooth and easy seat adjustment. Further, it is important that the options and features are incorporated into the seating unit construction such that manufacturing and assembly efficiency and ease of user adjustability are maximized, while at the same time having an aesthetically pleasing design.

Accordingly, a seating unit construction solving the aforementioned problems is desired.

BRIEF SUMMARY OF THE INVENTION

In one embodiment of the present invention, a seating unit includes a seat assembly and an adjustment assembly coupled to the seat assembly. The adjustment assembly includes a single drive mechanism for translating the seat assembly from a first position to a second position and expanding the seat assembly from a first configuration to a second configuration.

In another embodiment of the present invention, a seating unit includes an adjustment assembly operably coupled to a seat assembly. The adjustment assembly includes a drive mechanism for translating the seat assembly from a first position to a second position and expanding the seat assembly from a first configuration to a second configuration. The seat assembly includes a cushion assembly having a forward portion with two or more cutouts and a leading edge. The two or more cutouts are in a compressed state when the seat assembly is in the first configuration relative to the second configuration.

In yet another embodiment of the present invention, a seating unit includes a drive mechanism operably coupled to a seat assembly. The drive mechanism translates the seat assembly from a first position to a second position and expands the seat assembly from a first configuration to a second configuration. The seat assembly includes a cushion assembly having two or more nested cushion portions. The two or more nested cushion portions are separated when the seat assembly moves from the first configuration to the second configuration.

In another embodiment of the present invention, a seating assembly includes a seat support structure, a seat support pan, a seat extension member and a drive mechanism. The drive mechanism includes a housing having a threaded portion, a first drive screw threadably received within the housing threaded portion, a seat drive member including a body portion having a threaded portion which threadably engages a second drive screw and a plurality of guide legs which engage and track along sides of the housing, and an extension drive member positioned between the first drive screw and the second drive screw. The housing is secured to the seat support structure, the seat drive member is secured to the seat support pan, and the extension drive member is secured to the seat extension member.

These and other aspects, objects, and features of the present invention will be understood and appreciated by those skilled in the art upon studying the following specification, claims and appended drawings.

BRIEF DESCRIPTION OF THE DRAWINGS

The foregoing and other items and advantages of the present invention will be appreciated more fully from the following figures, where like reference characters designate like features in which.

DETAILED DESCRIPTION OF THE INVENTION

Figure 1:
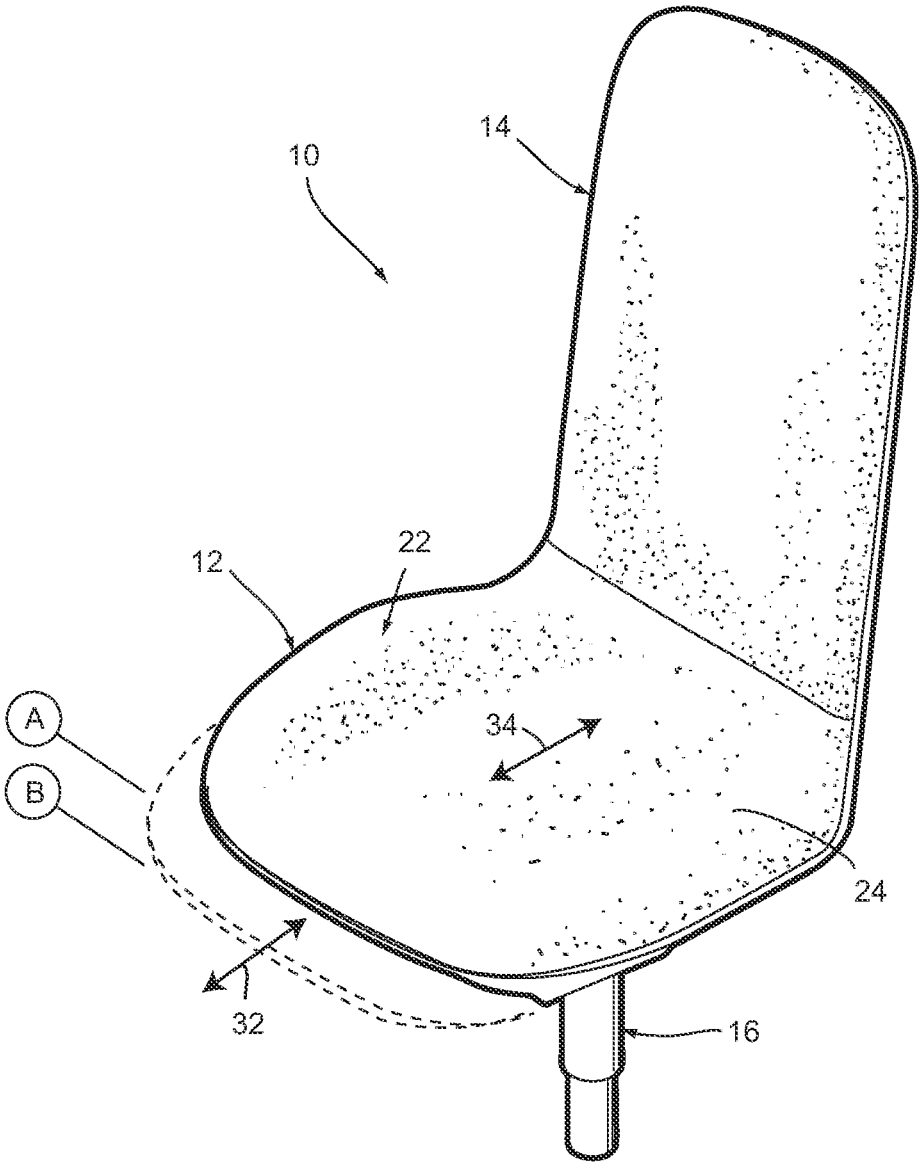
FIG. 1 is a perspective view of a seating unit including a depth and position-adjustable seat having a comfort surface.

For purposes of description herein, the terms "rear," "front," "vertical," "horizontal," and derivatives thereof shall relate to a seating unit as oriented in FIG. 1. However, it is to be understood that the seating unit may assume various alternative orientations, except where expressly specified to the contrary. It is also to be understood that the specific devices illustrated in the attached drawings, and described below are simply exemplary embodiments of the invented concepts. Hence, specific dimensions and other physical characteristics relating to the embodiments disclosed herein are not to be considered as limiting.

Figure 2:
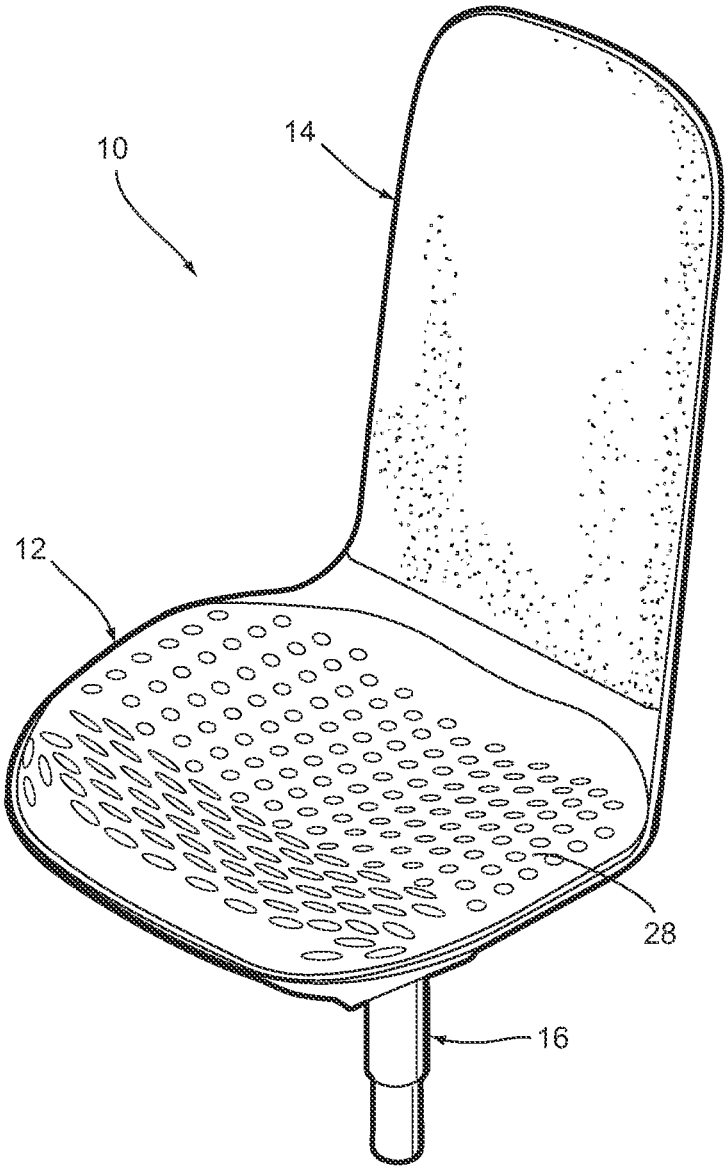
FIG. 2 is a perspective view of the seating unit of FIG. 1 with the comfort surface removed from the seat.
Figure 3:
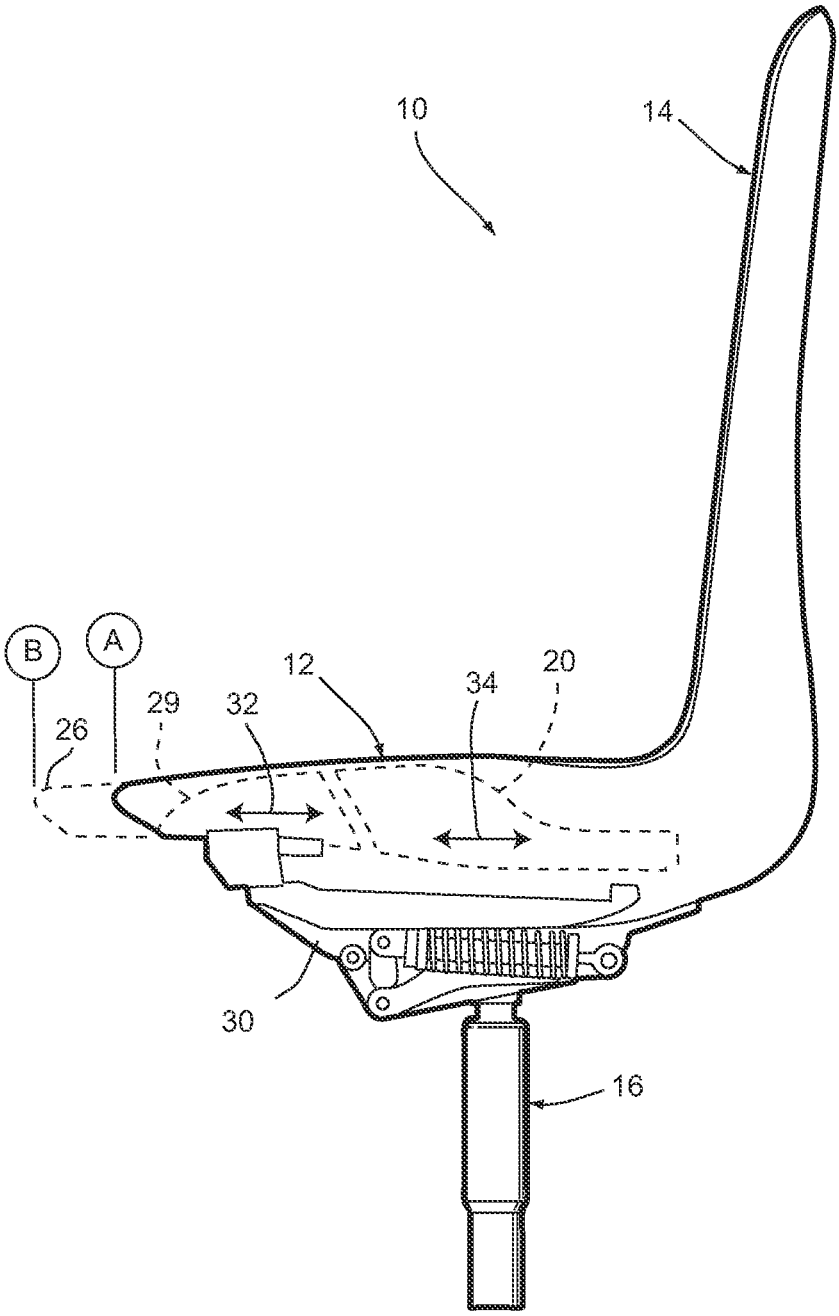
FIG. 3 is a right side view of the seating unit of FIG. 1 including a cross-sectional view of the depth and position-adjustable seat.

A seating unit 10 includes a seat assembly 12, a back assembly 14, a support assembly 16 and an adjustment assembly 18. The seating unit may also include arm assemblies (not shown). FIGS. 1-3 illustrate one embodiment of the seating unit 10, namely an office chair. However, it is contemplated that the scope of the present invention includes any seating unit having a seat assembly, a back assembly and a support assembly, including, but not limited to, a chair, a motor vehicle seat, an airplane seat, and a wheelchair. Accordingly, the present invention is not intended to be unnecessarily limited and the term "seating unit" as used herein is intended to be broadly construed.

The seat assembly 12 includes a seat support pan 20 covered by a cushion assembly 22 having a comfort surface 24, or by a comfort surface 24 alone. A front edge of the comfort surface 24 or cushion assembly 22 defines a leading edge 26 of the seat assembly 12. Typically, the seat assembly 12 support pan 20 is covered by a cushion assembly 22 including the comfort surface 24 supported by a cushion 28. Likewise, the back assembly 14 includes a back shell covered by a comfort surface or a back cushion assembly, where the back cushion assembly includes a back cushion covered by the comfort surface. The cushion assembly 22 covering the seat assembly 12 may be separate from the cushion assembly covering the back assembly 14 or combined. The seat assembly 12 also includes a seat extension member 29. The seat assembly may further include a seat support structure 30 supported by the support assembly 16. The seat extension member 29 is expandable in a direction 32 between a first configuration A and a second configuration B and the support pan 20 is translatable in direction 34 between a first position and a second position.

Figure 4:
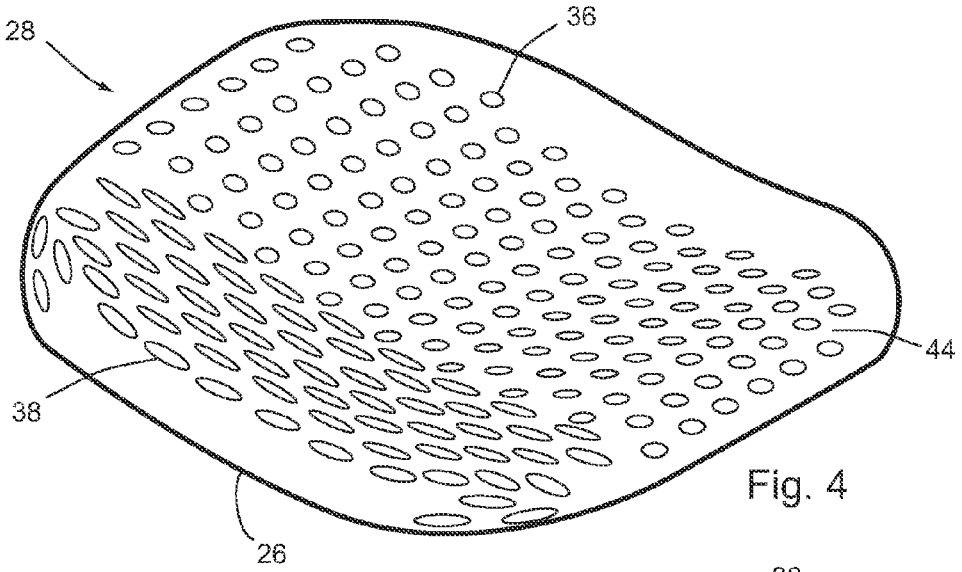
FIG. 4 is a perspective view of a first embodiment of a cushion.
Figure 5:
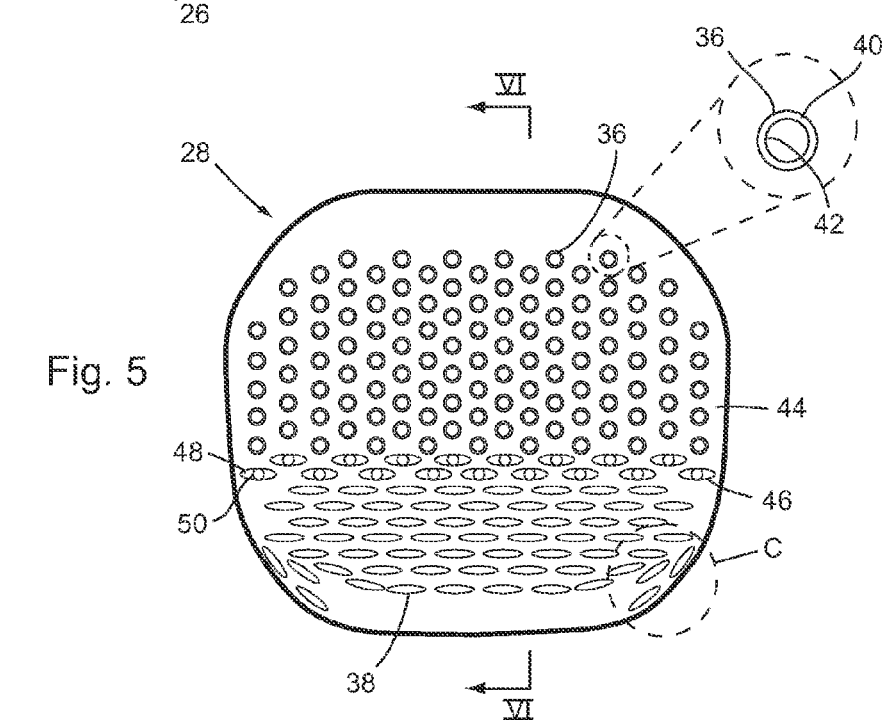
FIG. 5 is a top view of the cushion of FIG. 4 including a fragmentary view of a cutout.
Figure 6:
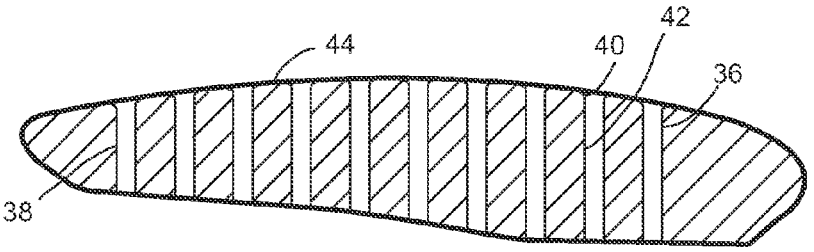
FIG. 6 is a cross-sectional view of the cushion of FIG. 4.

The comfort surface 24 includes a resilient fabric and the cushion 28 includes a foamed elastomeric compound. Suitable foamed elastomeric compounds include, but are not limited to, polyethylene, latex, and polyurethane foams, and combinations thereof. In a first illustrated example (FIGS. 4-6), the cushion 28 includes a plurality of cutouts extending therethrough. In particular, the cushion 28 includes circularly-shaped cutouts 36 and elongated cutouts 38. As best illustrated in FIGS. 5 and 6, each cutout 36, 38 includes a molded upper portion 40 and a die cut lower portion 42. The upper portion 40 is molded into an upper surface 44 of the cushion 28 as the cushion 28 is formed, and includes radiused or rounded edges which define the location for each of the cutouts 36, 38. The lower portion 42 of each of the cutouts 36, 38 is then die cut such that the overall cutout 36, 38 extends through the entire depth of the cushion 28. The forming of the cutouts 36, 38 within the cushion 28 adjusts the spring rate of the cushion 28 in the vicinity of the cutouts 36, 38. The forming of the rounded upper portion of each of the cutouts 36, 38 provides added comfort to the seated user, as well as improves the aesthetic appearance of the seat assembly 12 when the comfort surface 24 is tightly stretched over the seat assembly 12.

Referring to FIG. 5, either cutouts 36, 38 may be replaced by cutouts 46 having variable cross-sectional configurations. Each cutout 46 includes an elongated or football-shaped upper portion 48 and a circularly-shaped lower portion 50. The overall cutout 46 extends through the entire depth of the cushion 28. By combining the elongated upper portion 48 with the circularly-shaped lower portion 50, the overall spring rate as provided by the cushion 28 is similar to that as provided by cutouts 36, while the aesthetic appearance is similar to that as provided by cutouts 38.

Still referring to FIG. 5, the cutouts 36, 38 are selectively spaced about the cushion 28. The spring rate of the cushion 28 in any particular location may be adjusted by adjusting the relative spacing of the cutouts 36, 38 from one another and from the edges of the cushion 28. Further, spacing of the cutouts allows adjustment of the spring rate to compensate for various foam thicknesses, as the cushion 28 can vary in thickness across a width W and length L thereof. The spring rate in any particular area of the cushion 28 in both a vertical and horizontal direction may be adjusted by changing the orientation of the cutouts. As exemplified in area C, the orientation of cutouts 38 have been adjusted such that the cutouts 38 extend somewhat parallel with the outer edges of the cushion 28.

Figure 7:
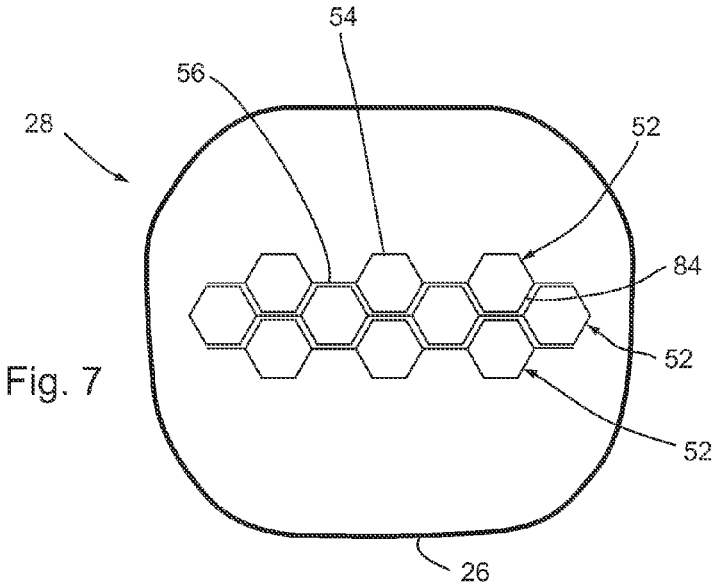
FIG. 7 is a top view of a second embodiment of a cushion.
Figure 8:
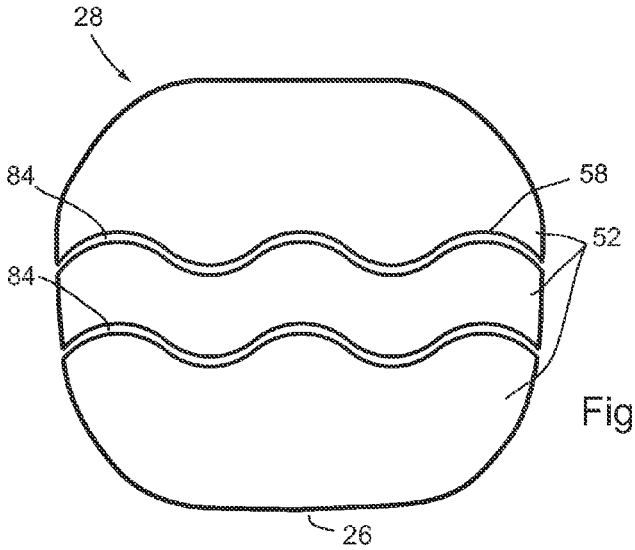
FIG. 8 is a top view of a third embodiment of a cushion.

Alternatively, instead of cutouts 36, 38, the cushion 28 may include two or more nested portions 52, where a nested portion is positioned adjacent to at least one other nested portion. The configuration of the nested portions 52 can vary. For example, as illustrated in FIG. 7, each nested portion 52 includes cutouts 54 connected by linking structures 56, with a cutout 54 of one nested portion 52 juxtaposed to the linking structure 56 of another nested portion. Although cutouts 54 include a hexagonal structure is shown in FIG. 7, any regular or irregular polygonal shape is suitable. FIG. 8 illustrates another example of a cushion 28 including nesting portions 52 having an undulating wave shape 58.

Referring now to FIGS. 9-13, the adjustment assembly 18 is a single drive mechanism and includes a housing 60 having a threaded portion 62 and a guide portion 64, a first drive screw 66 threadably received within the threaded portion 62, a second drive screw 68 located within the guide portion 64 and threadably receiving a seat drive member 70 thereon, and an extension drive member 72 positioned between the first drive screw 66 and the second drive screw 68. The seat drive member 70 includes a body portion 74 and a plurality of guide legs 76 that engage and track along sides of the housing 60. The body portion 74 of the seat drive member 70 includes a threaded portion 78 that threadably engages the second drive screw 68. The adjustment assembly 18 is operably attached to the seat assembly 12 with the housing 60 fixedly secured to the seat support structure 30, the seat drive member 70 fixedly secured to the seat support pan 20, and the extension drive member 72 fixedly secured to the seat extension member 29.

Figure 9:
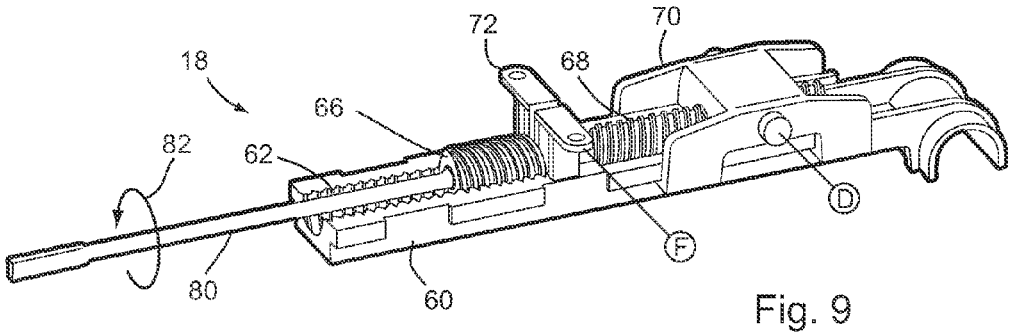
FIG. 9 is a perspective view of an adjustment assembly shown in a first position.
Figure 10:
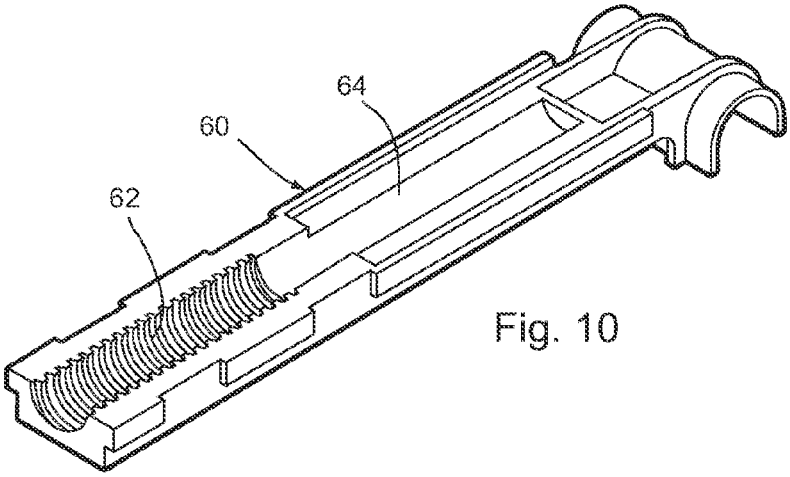
FIG. 10 is a top perspective view of a housing of the adjustment assembly of FIG. 9.
Figure 11:
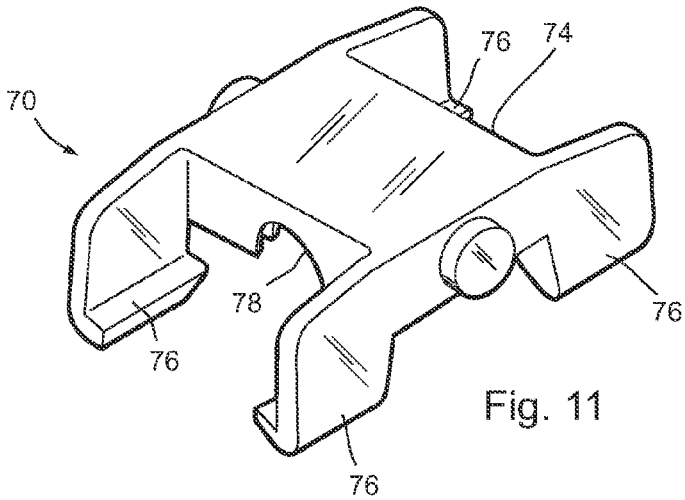
FIG. 11 is a top perspective view of a seat drive member of the adjustment assembly of FIG. 9.
Figure 12:
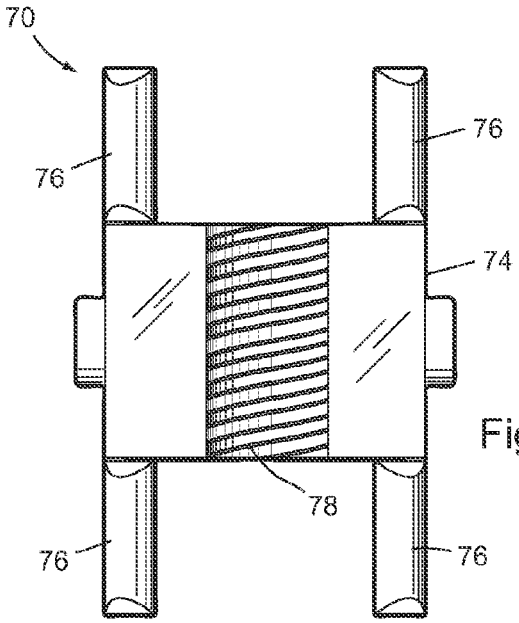
FIG. 12 is a bottom view of the seat drive member of FIG. 11.
Figure 13:
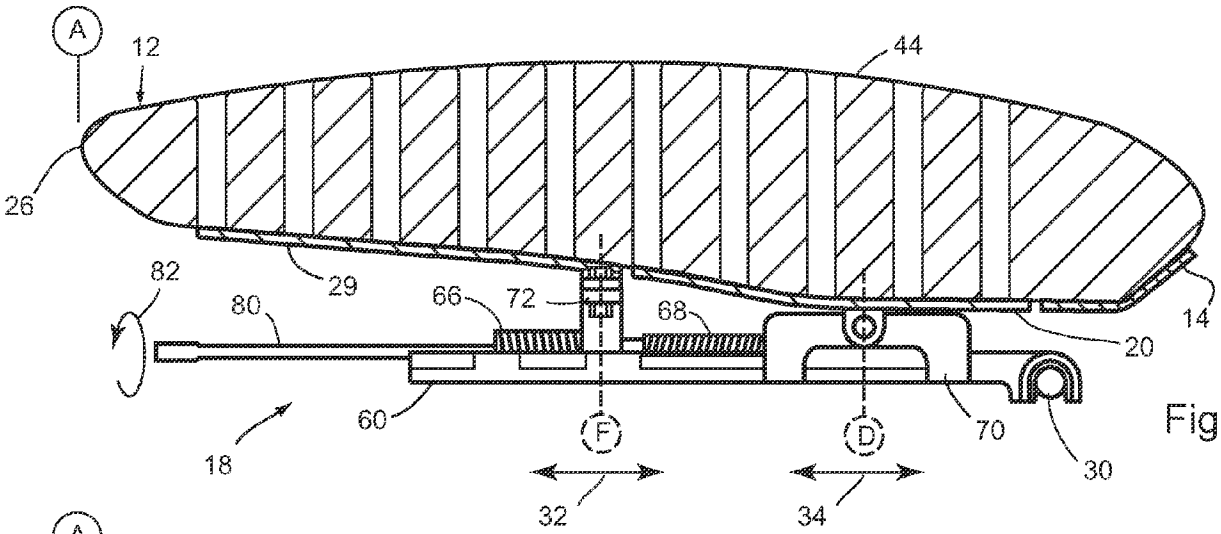
FIG. 13 is a cross-sectional view of the depth and position-adjustable seat, shown in a first position.
Figure 14:
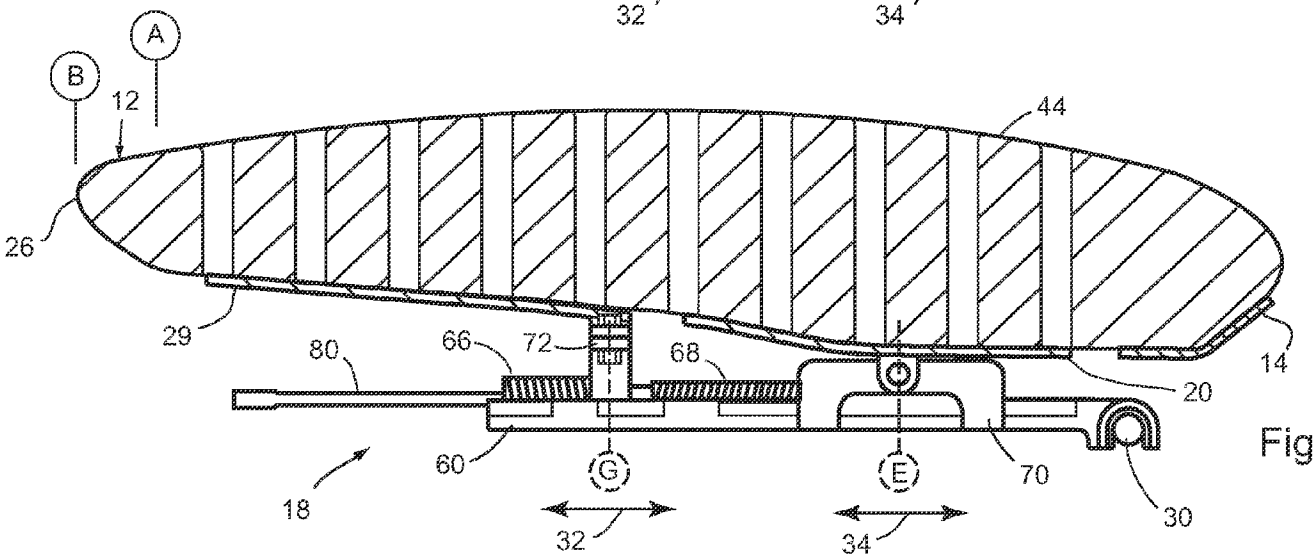
FIG. 14 is a cross-sectional view of the depth and position-adjustable seat, shown in a second position.

In operation, a user can translate and expand the seat assembly 12 by adjusting a single control mechanism. In particular, as illustrated in FIGS. 9, 13 and 14, a rotational input from the user rotates an input device, such as control handle 80, in a direction 82, thereby rotating the first drive screw 66 and the second drive screw 68 and moving the seat drive member 70 and seat support pan 20 from a first position D to a second position E and expanding the extension drive member 72 and seat extension member 29 from a first position F to a second position G. Translation and expansion are coordinated and occur such that the relative position of the leading edge 26 of the seat assembly 12 can be adjusted between a fully retracted position and configuration, where the seat extension member 29 is in the first configuration A and the support pan 20 is in the first position, and a fully extended position and configuration, where the seat extension member 29 is in the second configuration B and the support pan is in the second position. Typically, coordinated translation and expansion movements occur simultaneously, but movements may also occur alternately. Where movements are simultaneous, translation of the seat support pan 20 and expansion of the seat extension member 29 may occur synchronously or at different rates. The thread ratio between the first drive screw 66 and the second drive screw 68 may be adjusted to adjust the overall ratio between which the position of the seat assembly and the overall depth of the seat assembly are adjusted.

As the seat extension member 29 expands from the first configuration A to the second configuration B, the length L of the cushion assembly 22 increases. In the first configuration A, the leading edge 26 is substantially linear, but seat assembly 12 may include radiused or rounded corners to form a slightly convex leading edge. In one embodiment, as the seat assembly 12 moves from the first configuration A to the second configuration B, the leading edge 26 becomes more convex. In another embodiment, as the seat assembly 12 moves from the first configuration A to the second configuration B, the leading edge 26 remains substantially linear.

In the first configuration A, cushion 28 is in a compressed state such that voids formed by cutouts 36, 38, 54 or gaps 84 between nesting portions 52 are minimized. As a cushion 28 having cutouts 36, 38 or cutouts 54 expands from the first configuration A to the second configuration B, the size of the voids increase and the cushion progresses from the compressed state to a less compressed state. As a cushion 28 including nested portions 52 expands from the first configuration A to the second configuration B, the nested portions separate from each other, thereby increasing gaps 84 between adjacent nested portions.

In the foregoing description, it will be readily appreciated by those skilled in the art that modifications may be made to the invention without departing from the concepts disclosed. Such modifications are to be considered as included in the following claims, unless these claims by their language expressly state otherwise.

The invention claimed is:

1. A seating unit comprising:

a seat assembly including a seat support pan;

a back assembly; and an adjustment assembly coupled to the seat assembly, wherein the adjustment assembly includes a single drive mechanism for translating the seat assembly support pan horizontally in a forward direction away from the back assembly from a first position to a second position and expanding the seat assembly horizontally in a forward direction away from the back assembly from a first configuration to a second configuration.

2. The seating unit of claim 1, wherein the translation of the seat support pan and expansion of the seat assembly are coordinated.

3. The seating unit of claim 1, wherein the seat support pan translates from the first position to the second position and the seat assembly expands from the first configuration to the second configuration simultaneously.

4. The seating unit of claim 3, wherein the single drive mechanism synchronously translates the seat support pan and expands the seat assembly.

5. The seating unit of claim 1, wherein the single drive mechanism comprises:

a housing having a threaded portion;

a first drive screw threadably received within the housing threaded portion;

a seat drive member including a body portion having a threaded portion which threadably engages a second drive screw and a plurality of guide legs which engage and track along sides of the housing; and an extension drive member positioned between the first drive screw and the second drive screw.

6. The seating unit of claim 5 further comprising:

a seat support structure; and a seat extension member;

wherein the housing is secured to the seat support structure, the seat drive member is secured to the seat support pan, and the extension drive member is secured to the seat extension member.

7. A seating unit comprising:

a back assembly;

an adjustment assembly operably coupled to a seat assembly including a support pan and a cushion assembly, wherein the adjustment assembly includes a drive mechanism for translating the support pan horizontally in a forward direction away from the back assembly from a first position to a second position and expanding the seat assembly horizontally in a forward direction away from the back assembly from a first configuration to a second configuration;

wherein the cushion assembly includes a forward portion having two or more cutouts and a leading edge; and wherein the two or more cutouts are in a compressed state when the seat assembly is in the first configuration relative to the second configuration.

8. The seating unit of claim 7, wherein the first configuration comprises the leading edge having a substantially linear shape and the second configuration comprises the leading edge having a convex shape.

9. The seating unit of claim 7, wherein the cushion assembly further comprises a first length in the first configuration and a second length in the second configuration, and wherein the first length is less than the second length.

10. The seating unit of claim 9, wherein the first configuration comprises the leading edge having a substantially linear shape and the second configuration comprises the leading edge having a convex shape.

11. The seating unit of claim 9, wherein the second configuration comprises the leading edge having a convex shape and the first configuration comprises the leading edge having a less convex shape relative to the second configuration.

12. The seating unit of claim 7, wherein the translation of the support pan and expansion of the seat assembly are coordinated.

13. The seating unit of claim 7, wherein the support pan translates and the seat assembly expands simultaneously.

14. The seating unit of claim 13, wherein the drive mechanism synchronously translates the support pan and expands the seat assembly.

15. The seating unit of claim 7, wherein the drive mechanism is a single drive mechanism.

16. The seating unit of claim 7, wherein the drive mechanism comprises:

a housing having a threaded portion;

a first drive screw threadably received within the threaded portion;

a seat drive member including a body portion having a threaded portion which threadably engages a second drive screw and a plurality of guide legs which engage and track along sides of the housing; and an extension drive member positioned between the first drive screw and the second drive screw.

17. A seating unit comprising:

an adjustment assembly operably coupled to a seat assembly including a cushion assembly, wherein the adjustment assembly includes a drive mechanism for translating the seat assembly from a first position to a second position and expanding the seat assembly from a first configuration to a second configuration;

wherein the cushion assembly includes a forward portion having two or more cutouts and a leading edge;

wherein the two or more cutouts are in a compressed state when the seat assembly is in the first configuration relative to the second configuration; and wherein the second configuration comprises the leading edge having a convex shape and the first configuration comprises the leading edge having a less convex shape relative to the second configuration.

18. A seating unit comprising:

a back assembly;

a drive mechanism operably coupled to a seat assembly including a seat support pan and a cushion assembly having two or more nested cushion portions, wherein the drive mechanism translates the seat support pan horizontally in a forward direction away from the back assembly from a first position to a second position and expands the seat assembly horizontally in a forward direction away from the back assembly from a first configuration to a second configuration; and wherein the two or more nested cushion portions are separated when the seat assembly moves from the first configuration to the second configuration.

19. The seating unit of claim 18, wherein the cushion assembly further comprises a leading edge, and wherein the first configuration comprises the leading edge having a substantially linear shape and the second configuration comprises the leading edge having a convex shape.

20. The seating unit of claim 18, wherein the cushion assembly further comprises a first length in the first configuration and a second length in the second configuration and wherein the first length is less than the second length.

21. The seating unit of claim 20, wherein the cushion assembly further comprises a leading edge, and wherein the first configuration comprises the leading edge having a substantially linear shape and the second configuration comprises the leading edge having a convex shape.

22. The seating unit of claim 20, wherein the cushion assembly further comprises a leading edge, and wherein the second configuration comprises the leading edge having a convex shape and the first configuration comprises the leading edge having a less convex shape relative to the second configuration.

23. The seating unit of claim 18, wherein the drive mechanism is a single drive mechanism.

24. The seating unit of claim 18, wherein the drive mechanism comprises:

a housing having a threaded portion;

a first drive screw threadably received within the threaded portion;

a seat drive member including a body portion having a threaded portion which threadably engages a second drive screw and a plurality of guide legs which engage and track along sides of the housing; and an extension drive member positioned between the first drive screw and the second drive screw.

25. A seating unit comprising:

a drive mechanism operably coupled to a seat assembly including a cushion assembly having two or more nested portions, wherein the drive mechanism translates the seat assembly from a first position to a second position and expands the seat assembly from a first configuration to a second configuration;

wherein the two or more nested cushion portions are separated when the seat assembly moves from the first configuration to the second configuration; and wherein the cushion assembly further comprises a leading edge, and wherein the second configuration comprises the leading edge having a convex shape and the first configuration comprises the leading edge having a less convex shape relative to the second configuration.

26. A seat assembly comprising:

a seat support structure;

a seat support pan;

a seat extension member; and a drive mechanism comprising:

a housing having a threaded portion;

a first drive screw threadably received within the housing threaded portion;

a seat drive member including a body portion having a threaded portion which threadably engages a second drive screw and a plurality of guide legs which engage and track along sides of the housing;

an extension drive member positioned between the first drive screw and the second drive screw; and wherein the housing is secured to the seat support structure, the seat drive member is secured to the seat support pan, and the extension drive member is secured to the seat extension member.

27. The seat assembly of claim 26, wherein the drive mechanism translates the seat assembly from a first position to a second position and expands the seat assembly from a first configuration to a second configuration.

28. The seat assembly of claim 26, wherein the drive mechanism simultaneously translates the seat assembly from a first position to a second position and expands the seat assembly from a first configuration to a second configuration.

29. The seating unit of claim 26, wherein the drive mechanism translates the seat assembly from a first position to a second position and expands the seat assembly from a first configuration to a second configuration, and wherein the translation and expansion of the seat assembly are coordinated.

30. The seat assembly of claim 26, wherein the drive mechanism synchronously translates the seat assembly from a first position to a second position and expands the seat assembly from a first configuration to a second configuration.

* * * * *

UNITED STATES PATENT AND TRADEMARK OFFICE

CERTIFICATE OF CORRECTION

PATENT NO. : 8,991,921 B2
APPLICATION NO. : 13/553979
DATED : March 31, 2015
INVENTOR(S) : Gordon Jay Peterson et al.

It is certified that error appears in the above-identified patent and that said Letters Patent is hereby corrected as shown below:

In the Specification

Col. 2, line 38: “depth” should be — depth- —

Col. 2, line 42: “depth” should be — depth- —

Col. 2, line 59: “depth” should be — depth- —

Col. 2, line 61: “depth” should be — depth- —

Col. 4, line 19: “have” should be — has —

Col. 4, line 30 (1st occurrence): “is” should be — as —

Col. 5, line 27: “increase” should be — increases —

In the Claims

Col. 5, claim 1, line 45: Delete “assembly”

Signed and Sealed this
Eighth Day of September, 2015

Michelle K. Lee

Michelle K. Lee
*Director of the United States Patent and Trademark Office*